United States Patent [19]

Schulz et al.

[11] Patent Number: 4,741,813

[45] Date of Patent: May 3, 1988

[54] DIAPHRAGM FOR AN ELECTROLYTIC CELL

[75] Inventors: Arthur C. Schulz, North Tonawanda; Robert Kiszewski, Niagara Falls, both of N.Y.; Ursula I. Keller, Queenston, Canada

[73] Assignee: OxyTech Systems, Inc., Chardon, Ohio

[21] Appl. No.: 941,459

[22] Filed: Dec. 15, 1986

[51] Int. Cl.[4] ..... C25B 13/00

[52] U.S. Cl. ..... 204/295; 427/295; 428/443

[58] Field of Search ..... 204/295; 427/393.6, 427/294–296; 428/443

[56] References Cited

U.S. PATENT DOCUMENTS

| | | | |
|---|---|---|---|
| 4,003,818 | 1/1977 | Juillard et al. | 204/296 |
| 4,142,951 | 3/1979 | Beaver et al. | 204/296 |
| 4,173,526 | 11/1979 | Fang | 204/295 |
| 4,180,449 | 12/1979 | Heikel | 204/296 |
| 4,410,411 | 10/1983 | Fenn, III et al. | 204/296 |

FOREIGN PATENT DOCUMENTS

| | | | |
|---|---|---|---|
| 1027898 | 3/1978 | Canada | 204/201 |

*Primary Examiner*—R. L. Andrews

*Attorney, Agent, or Firm*—John J. Freer; William G. Gosz

[57] ABSTRACT

An improved diaphragm for an electrolytic cell is prepared by mixing a slurry of asbestos fibers with a dispersion of titanium dioxide in isopropyl alcohol, depositing the treated asbestos fibers onto a cathode, heating the diaphragm to an elevated temperature of from about 100° C. to about 300° C., and allowing the diaphragm to cool.

The diaphragm prepared according to this process exhibits improved mechanical strength and integrity as well as a decrease in electrical energy consumption in comparison to diaphragms prepared using conventional techniques.

10 Claims, No Drawings

DIAPHRAGM FOR AN ELECTROLYTIC CELL

BACKGROUND OF THE INVENTION

The present invention relates to a process for preparing an improved diaphragm for use in chlor-alkali electrolytic cells. The diaphragm of this invention has improved mechanical properties which result in superior electrical performance and increased energy savings.

The chlor-alkali industry currently employs a large number of electrolytic diaphragm cells for the commercial production of chlorine and caustic soda. These electrolytic cells have an anode contained in an anolyte chamber and a cathode contained in a catholyte chamber separated by a porous diaphragm. The diaphragm is generally formed by depositing a slurry of asbestos fibers directly onto the foraminous cathode. The cells contain brine which is electrolyzed to produce chlorine gas in the anolyte chamber and sodium hydroxide (caustic) in the catholyte chamber.

Technical advances in this field have generated various improvements in component service life and cell operating efficiency or energy savings. These technical developments include dimensionally stable anodes, polymer reinforced diaphragms, activated cathodes, and decreased anode/cathode gaps. The improved electrodes have lower overvoltages and increased service life, while the polymer reinforced asbestos diaphragm has reduced swelling which enables the anode/cathode gap to be significantly decreased.

Present technology for preparing reinforced asbestos diaphragms requires the use of various polymeric reinforcing agents which are added to a slurry of asbestos fibers prior to deposition onto a cathode. The polymers used in this application must be resistant to attack and degradation by the electrolytic solution and cell products. Typical polymers include the fluorocarbon polymers such as polytetrafluoroethylene and polychlorotrifluoroethylene.

After being deposited onto the cathode, the diaphragm/cathode structure is heated to the fusion point of the polymer and subsequently cooled to room temperature. The deposition of the slurry is effected by means of a vacuum. Polymer-reinforced diaphragms of this type are disclosed in U.S. Pat. No. 4,410,411, issued Oct. 18, 1983 to Fenn et al., U.S. Pat. No. 4,142,951, issued Mar. 6, 1979 to Beaver et al., and Canadian Pat. No. 1,027,898 to Rucker. U.S. Pat. No. 4,142,951 also discloses that various surfactants, wetting agents, dispersing agents, modifiers or other processing aids can be added to the asbestos slurry in order to improve the dispersion of the asbestos fibers and fluorocarbon polymer and to impart increased porosity to the diaphragm. Titanium dioxide is listed in this patent as such a processing aid.

Although the polymer-reinforced diaphragms of the prior art do possess improved mechanical stability as compared to unmodified asbestos diaphragms, there are still opportunities for further technical improvements. For example, polymer-reinforced diaphragms prepared from polymers which are less resistant to the cell environment swell after a few days exposure to the cell environment, and the polymer itself tends to be degraded over a period of time, losing its capacity to effectively bond the fibers. Alternatively, when using more environmentally resistant polymers, the diaphragm-deposited cathode must be heated to the fusion temperature of the polymer which is typically in the range of about 350° C. In addition to requiring more expensive heating furnaces, the use of such high temperature conditions can accelerate the mechanical degradation of the cathode and diaphragm.

An attempt to overcome the shortcomings of polymer-modified asbestos diaphragms is disclosed in U.S. Pat. No. 4,180,449, issued Dec. 25, 1979, to Heikel. This patent utilizes an organic titanate, such as tetraisopropyl titanate, which is dissolved in a solvent capable of wetting the asbestos fibers, such as anhydrous isopropanol. The titanate solution is used to impregnate a diaphragm which has been previously deposited onto a cathode member by vacuum deposition. The diaphragm is dried prior to treatment with the titanate solution to prevent hydrolysis of the titanate compound. The titanate contained in the diaphragm must then be hydrolyzed prior to pyrolysis. Hydrolysis is carried out in the presence of a hydrolyzing agent, such as water vapor, while pyrolysis occurs at temperatures of about 400° C. The diaphragm produced according to this process is stated to be more durable and stable than unmodified diaphragms. However, this multistep process is both cumbersome and expensive to run commercially, and in addition it still requires very high heating temperatures.

It is therefore a principle objective of the present invention to provide an improved process for preparing an electrolytic chlor-alkali cell diaphragm which has superior physical and electrical properties in comparison to diaphragms disclosed in the prior art and those currently in commercial use.

SUMMARY OF THE INVENTION

In accordance with the present invention, a process for preparing an improved electrolytic cell diaphragm comprises the steps of (A) forming an aqueous dispersion of at least one valve metal oxide and at least one water-soluble solvent which is capable of wetting the valve metal oxide and the asbestos fibers, (B) mixing the dispersion with asbestos fibers to form a slurry, (C) immersing a cathode in the slurry and depositing a uniform mixture of slurry solids onto the cathode, (D) heating the diaphragm-deposited cathode at a temperature of at least about 100° C. to cure the diaphragm, and (E) allowing the diaphragm to cool.

Preferably, the cell is a chlor-alkali cell, the valve metal oxide of choice is titanium dioxide and the solvent of choice is isopropanol. A wetting agent can be incorporated in the slurry for improved wetting of the asbestos fibers and dispersion of the solids prior to deposition onto the cathode.

DETAILED DESCRIPTION OF THE INVENTION

The diaphragm of the present invention is formed by depositing treated asbestos fibers onto a suitable cathode member. The cathode member, which generally traverses the width of the cell and is adapted to be interposed between adjacent anode members, is a foraminous structure, such as a perforated sheet or expanded or woven metal screen. The cathode is generally fabricated from steel and may also have an activated coating on its surface.

Procedures for depositing the fibers onto the cathode are well known in the art and involve either one- or two-stage variations. In the one-stage process, a slurry containing a mixture of asbestos fiber and a fluoropolymer is deposited onto a cathode member, while in the two-stage process, asbestos fibers are first deposited and subsequently impregnated with a thermoplastic fluoropolymer. These techniques are disclosed in U.S. Pat. No. 4,410,411 and Canadian Pat. No. 1,027,898, respectively, the disclosures of which are incorporated herein by reference.

Irrespective of the particular deposition process employed, the first step is the preparation of a slurry of asbestos fibers. Suitable asbestos fibers are also well known in the art and include the crocidolite and chrysotile varieties. Particularly suitable are mixtures of the Hooker 1 and Hooker 2 fibers, and preferably equal weight mixtures of these fibers.

The asbestos fiber slurry is modified by the addition thereto of a valve metal oxide and a water soluble solvent. The valve metal oxide and solvent are first combined as a dispersion and subsequently added to the asbestos slurry. This insures complete dispersion of the valve metal oxide particles in the solvent.

The valve metal oxide is in particulate or finely divided form, and is preferably a pigment grade material. For purposes of this invention, the term "valve metal" includes titanium, zirconium, hafnium, niobium, tantalum and tungsten, or mixtures of any of these materials. These metal oxides are electrical insulators and will not interfere with electrical processes occurring within the cell. The preferred valve metal oxide is titanium dioxide.

Any alkanol such as methanol, ethanol and propanol, including both branch and straight chain varieties, both substituted and unsubstituted, can be used as the solvent in the practice in this invention, the only provision being that the alkanol must be soluble in water and should be capable of thoroughly wetting the valve metal oxide and the asbestos fibers.

A particularly preferred alkanol is isopropanol. Isopropanol is capable of readily dispersing titanium dioxide and is also effective in thoroughly wetting the asbestos fibers to form a complete and uniform dispersion of the titanium dioxide within the fiber matrix. It has been found that the use of such a solvent is essential to the practice of this invention since its omission results in a lack of bonding of the titanium dioxide to the asbestos fibers as illustrated in Example 4 below. In the absence of such a solvent, the titanium dioxide is exceedingly difficult to disperse, and upon depositing the diaphragm onto the cathode, does not adhere to the asbestos.

A wetting agent can be suitably added to the dispersion for improved wetting of the asbestos fibers. Typical wetting agents include the Triton products, which are manufactured and sold by the Rohm & Haas Corp. A particularly suitable wetting agent is Triton X-100, which is a non-ionic octyl phenoxy polyethoxy ethanol compound. Although such wetting agents are generally effective for wetting the asbestos fibers, they are not effective in wetting the valve metal oxide particles, and therefore, must be employed in combination with a solvent such as isopropanol which possesses this capability.

The amounts of the individual components required to achieve the beneficial results of this invention are not critical, and can vary within wide limits. In general, the amount of valve metal oxide employed should be sufficient to prevent substantial swelling of the asbestos diaphragm while in operation in the cell.

After the slurry has been prepared and thoroughly mixed, a cathode can be immersed therein and a vacuum applied through the cathode chamber to draw the fibers onto the cathode surface. The diaphragm-deposited cathode can then be removed from the slurry, dried and heated at a temperature of at least about 100° C., and preferably in the range of from about 100° C. to about 300° C., for a sufficient time to cure the diaphragm. Curing occurs when the asbestos fibers are firmly bound together to form an adherent and dimensionally stable structure, and is a function of the duration of the heat treatment and temperature employed.

A particular advantage of this invention is that a lower baking temperature can be employed then has been generally found necessary in the prior art. This assists in preventing damaging warpage of the cathode. In this manner, a diaphragm typically having a thickness of from about 30–125 mils can be obtained.

While the process of the present invention is primarily useful for preparing diaphragms for electrolytic cells, and particularly chlor-alkali cells, a variety of other useful articles can also be prepared following the procedure described herein, as will be readily understood by those skilled in the relevant art. These other articles include filters, mats and cords, as well as other porous structures formed from asbestos fibers by heating fibers which have been at least partially coated with a dispersion of a valve metal oxide in at least one solvent capable of wetting the valve metal oxide and asbestos fibers. The process of this invention is particularly useful for preparing such articles which are subject to high temperature conditions of use, since the inorganic binder does not decompose or degrade under such conditions.

The following examples are intended to further illustrate various embodiments of the present invention without limiting it thereby.

EXAMPLE 1

A slurry. was prepared by mixing 4.5 grams of Hooker #1 asbestos fiber and 4.5 grams of Hooker #2 asbestos fiber in 450 cc. of cell liquor (average concentration about 150 gpl NaOH). To this slurry was added a dispersion of 0.9 grams $TiO_2$ pigment grade powder, 0.9 mls. isopropyl alcohol, and 0.9 mls. of a 0.5% by weight solution of Triton X-100 wetting agent (trademark of Rohm & Haas Corp. for a non-ionic octyl phenoxy polyethoxy ethanol surfactant). The color of the slurry changed from grey to milky white.

This slurry was thoroughly mixed, deposited onto a cathode under vacuum and dried for about 2 hours under vacuum. The cathode was then placed in an oven and heated to 100° C.–120° C. for 2 hours. The oven temperature was then raised to 240° C. and held for one hour at this temperature to cure the cathode. The oven was then allowed to cool to ambient temperature.

The cathode was then installed in an electrolytic chlor-alkali laboratory cell and operated at an average current density of 1.5 ASI. An initial cell voltage of 3.33 and a caustic current efficiency, of 80.8% was recorded. After 20 days of operation, the cell voltage had fallen to 3.27 and the caustic current efficiency had increased to 90.13. The performance of this cell was observed to be improving with time.

The system was then shut down and the laboratory cell was dismantled. The cell was visually examined, and the appearance of the diaphragm was observed to be hard and uniformly white. The anode and anolyte compartment were sparkling clear and clean.

EXAMPLE 2

For a comparison, a slurry was prepared by mixing 4.5 grams of Hooker #1 asbestos fiber, 4.5 grams of Hooker #2 asbestos fiber, 0.9 grams of Halar powder (trademark of Allied Corp. for a polymer having a 1:1 weight ratio of chlorotrifluoroethylene and ethylene), and 0.9 mls. of a 0.5% by weight solution of Triton X-100 in 450 cc. of cell liquor (average concentration about 150 gpl NaOH).

This slurry was thoroughly mixed, deposited onto a cathode under vacuum, and dried for about 2 hours under vacuum. The cathode was then placed in an oven and heated to 100° C.–120° C. for 2 hours. The oven temperature was then raised to 240° C. and held for one hour at this temperature to cure the cathode. The oven was then allowed to cool to ambient temperature.

The cathode was then installed in an electrolytic chlor-alkali laboratory cell and operated at an average current density of 1.5 ASI. An initial cell voltage of 3.23 and a caustic current efficiency of about 100% were recorded. After 20 days of operation, the cell voltage had risen to 3.31 and the caustic current efficiency had decreased to 93.05%. In contrast to Example 1, the performance of this cell was observed to be declining with time.

The system was then shut down and the laboratory cell was dismantled. The cell was visually examined, and the appearance of the diaphragm was observed to be swollen, soft and spongy. Loose fibers were also observed in the anode and in the anolyte.

EXAMPLE 3

The procedure of Example 2 was repeated using the same conditions and materials for preparing the diaphragm-deposited cathode.

The cathode was again installed in a laboratory cell and operated at an average current density of 1.5 ASI. An initial cell voltage of 3.24 and a caustic current efficiency of about 100% were recorded. After 20 days of operation, the cell voltage had risen to 3.38 and the caustic current efficiency had decreased to 92.97. The performance of this cell was also observed to be declining with time.

The system was again shut down and the laboratory cell was dismantled. The cell was visually examined, and the appearance of the diaphragm was observed to be swollen and very soft. Many loose fibers had pushed through the anode and there were a lot of loose fibers in the anolyte.

EXAMPLE 4

As a further comparison, a deposited diaphragm was prepared following the general procedure of Example 1 except that the isopropyl alcohol was omitted. The mixture formed by the asbestos, $TiO_2$ and wetting agent was not a true dispersion but rather a lumpy mixture. After depositing and baking the diaphragm-deposited cathode, it was discovered that the $TiO_2$ did not adhere to the surface of the diaphragm and was easily wiped off.

Although various embodiments of this invention have been shown and described in the specification, this invention is intended to be construed liberally and not limited by any specific embodiments as will be readily appreciated by those skilled in the art. It is to be understood, therefore, that the appended claims are intended to cover all modifications and variations which are within the spirit and scope of the present invention.

What is claimed is:

1. A process for preparing a diaphragm for use in an elecrrolytic cell comprising the steps of:

(a) forming an aqueous dispersion of at least one valve metal oxide and at least one water-soluble solvent which is capable of wetting the valve metal oxide and asbestos fibers the valve metal oxide being selected from the group consisting of the oxides of titanium, zirconium, hafnium, niobium, tantalum, tungsten, and mixtures thereof, (b) mixing the dispersion with asbestos fibers to form a slurry, (c) immersing a cathode in the slurry and depositing a uniform mixture of slurry solids onto the cathode, (d) heating the diaphragrm-deposited cathode at a temperature of at least about 100° C. to cure the diaphragm, and (e) allowing the diaphragm to cool.

2. The process of claim 1 wherein the diaphragm is heated at a temperature of from about 100° C. to about 300° c.

3. The process of claim 1 wherein the valve metal oxide is titanium dioxide.

4. The process of claim 1 wherein at least one solvent is an alkanol.

5. The process of claim 4 wherein the alkanol is isopropanol.

6. The process of claim 5 wherein the valve metal oxide is titanium dioxide.

7. The process of claim 6 wherein the dispersion includes a wetting agent.

8. The process of claim 7 wherein the wetting agent is a non-ionic octyl phenoxy polyethoxy ethanol compound.

9. The process of claim 1 wherein the cell is an electrolytic chlor-alkali diaphragm cell.

10. A chlor-alkali cell diaphragm prepared by the process of claim 9.

* * * * *